US005404846A

United States Patent [19]

VanRens

[11] Patent Number: 5,404,846

[45] Date of Patent: Apr. 11, 1995

[54] FOUR STROKE ONE-PIECE ENGINE BLOCK CONSTRUCTION

[75] Inventor: Russell J. VanRens, Milwaukee, Wis.

[73] Assignee: Outboard Marine Corporation, Waukegan, Ill.

[21] Appl. No.: 235,367

[22] Filed: Apr. 29, 1994

[51] Int. Cl.[6] ..... F02F 1/10

[52] U.S. Cl. ..... 123/193.3; 123/193.2

[58] Field of Search ..... 123/193.3, 193.2, 193.1, 123/193.5

[56] References Cited

U.S. PATENT DOCUMENTS

| | | | |
|---|---|---|---|
| 2,401,211 | 5/1946 | Willgoos . | |
| 2,456,272 | 12/1948 | Gregory . | |
| 2,883,977 | 4/1959 | Langmaier | 123/193.3 |
| 3,674,000 | 7/1972 | Reisacher et al. | 123/193.3 |
| 3,691,914 | 9/1972 | Reisacher et al. | 92/169 |
| 3,897,770 | 8/1975 | Mettig et al. | 123/193.3 |
| 3,949,715 | 4/1976 | Faix et al. | 123/193.3 |
| 4,092,956 | 6/1978 | List et al. | 123/41.74 |
| 4,230,087 | 10/1980 | Abe et al. | 123/193.3 |
| 4,294,203 | 10/1981 | Jones | 123/195 R |
| 4,365,594 | 12/1982 | Obermayer et al. | 123/41.82 |
| 4,446,827 | 5/1984 | Kubozuka | 123/193.2 |
| 4,606,304 | 8/1986 | Kruger et al. | 123/90.27 |
| 4,630,345 | 12/1986 | Lutz . | |
| 4,699,100 | 10/1987 | Leydorf et al. | 123/193.3 |
| 4,708,105 | 11/1987 | Leydorf et al. | 123/193.3 |
| 4,856,462 | 8/1989 | Ushio et al. | 123/193.2 |

FOREIGN PATENT DOCUMENTS 3-206473 7/1991 Japan .

*Primary Examiner*—Andrew M. Dolinar
*Assistant Examiner*—M. Macy

[57] ABSTRACT

Disclosed herein is a four-stroke engine comprising a block having an intermediate portion defining a cylindrical bore having an axis, a head end, and a crankcase end, a head end portion extending from the head end of the intermediate portion in integral one-piece relation thereto and including a planar valve seat surface extending at an acute angle to the axis of the cylindrical bore and having a valve seat with a center and a perimeter defined by a radius extending from the center, and a crankcase end portion extending from the crankcase end of the intermediate portion in integral one-piece relation thereto and including a partially cylindrical portion coaxially aligned with the cylindrical bore, and a recessed portion extending from the partially cylindrical portion and having a peripheral wall spaced at a distance greater than the radius from a line extending perpendicularly to the valve seat surface and from said valve seat center.

2 Claims, 1 Drawing Sheet

FOUR STROKE ONE-PIECE ENGINE BLOCK CONSTRUCTION

BACKGROUND OF THE INVENTION

The invention relates generally to four stroke internal combustion engines which include, in the cylinder head, exhaust ports located in a surface which is inclined to the cylinder axis. In the past, machining of the inlet exhaust valve seats (in the inclined surface) surrounding the intake and outlet exhaust ports did not present a serious problem because the cylinders were fabricated separately from the cylinder block.

However, employment of inlet and exhaust valve seats in an inclined surface at the head end of a one-piece engine block presents serious problems.

Attention is directed to the following United States Patent list:

| U.S. Pat. No. | Inventor(s) | Issue Date |
|---|---|---|
| 2,401,211 | A. V. D. Willgoos | May 28, 1946 |
| 2,456,272 | A. T. Gregory | December 14, 1948 |
| 3,691,914 | Josef Reisacher | September 19, 1972 |
| 3,674,000 | Josef Reisacher | July 4, 1972 |
| 3,897,770 | Hermann Mettig | August 5, 1975 |
| 4,092,956 | Hans List | June 6, 1978 |
| 4,230,087 | Fumiyuki Abe | October 28, 1980 |
| 4,294,203 | Philip E. Jones | October 13, 1981 |
| 4,365,594 | Bertram Obermayer | December 28, 1982 |
| 4,606,304 | Hermann Kruger | August 19, 1986 |

Attention is also directed to Japanese Application No. 3-206473 filed Jul. 23, 1991.

SUMMARY OF THE INVENTION

The invention provides a four-stroke engine comprising a block having an intermediate portion defining a cylindrical bore having an axis, a head end, and a crankcase end, a head end portion extending from the head end of the intermediate portion in integral one-piece relation thereto and including a planar valve seat surface extending at an acute angle to the axis of the cylindrical bore and having a valve seat with a center and a perimeter defined by a radius extending from the center, and a crankcase end portion extending from the crankcase end of the intermediate portion in integral one-piece relation thereto and including a partially cylindrical portion coaxially aligned with the cylindrical bore, and a recessed portion extending from the partially cylindrical portion and having a peripheral wall spaced at a distance greater than the radius from a line extending perpendicularly to the valve seat surface and from the valve seat center.

The invention also provides a four-stroke engine comprising a one-piece block having an intermediate portion defining a cylindrical bore having an axis, a head end, and a crankcase end, a head end portion integrally extending from the head end of the intermediate portion and including an inclined surface extending at an acute angle to the axis of the cylindrical bore and having an exhaust port valve seat and an inlet port valve seat having respective centers and perimeters defined by radii extending from said centers, and a crankcase end portion integrally extending from the crankcase end of the intermediate portion and including a partially cylindrical portion coaxially aligned with the cylindrical bore, and a recessed portion extending from the partially cylindrical portion and having a peripheral wall including first and second lobes respectively defined by wall surfaces spaced at a distance greater than the radius from respective lines extending perpendicularly to and from the inclined surface and respectively from the valve seat centers.

Other features and advantages of the invention will become known by reference to the following general description, the appended claims and accompanying drawings.

Figure 1:
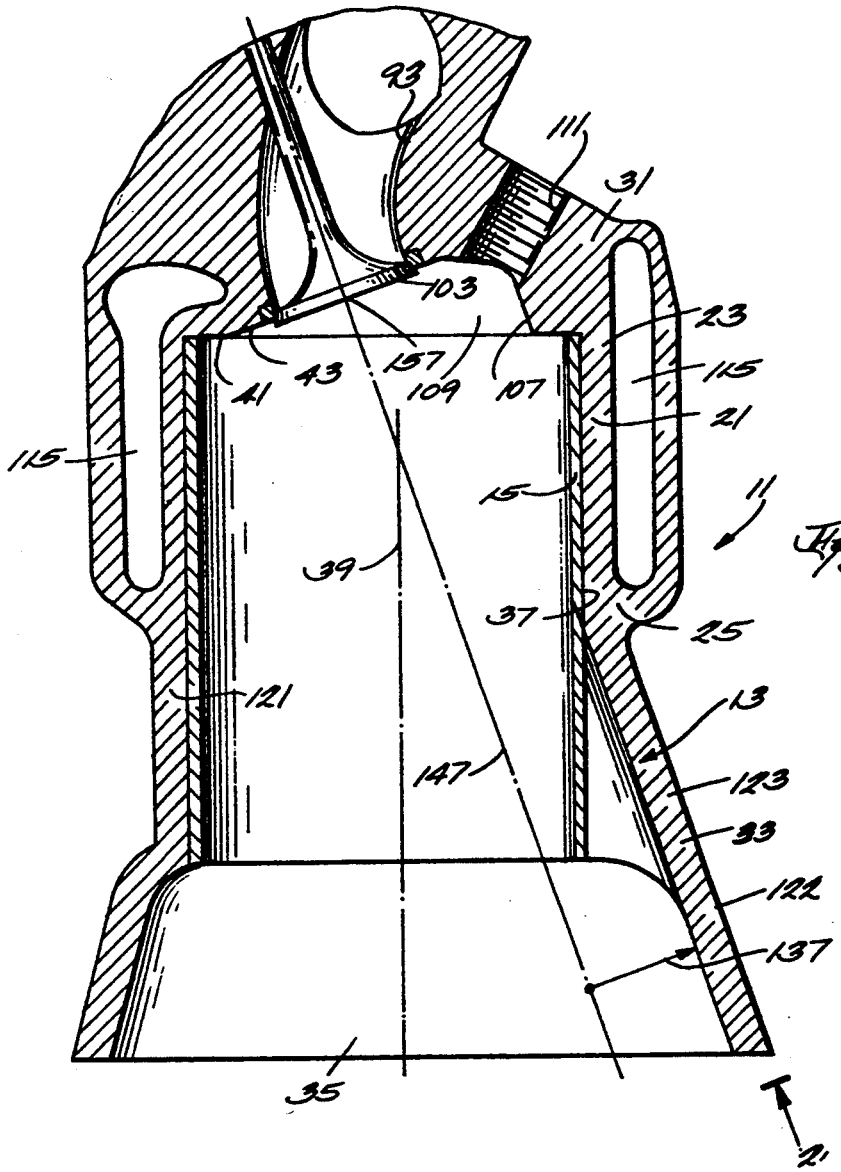
FIG. 1 is a fragmentary view, in section, of a one-piece four stroke engine block which incorporates various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in the drawings is an engine block assembly 11 for a four stroke internal combustion engine. The engine block assembly 11 includes an engine block 13 and a cylinder liner 15. The engine block 13 is a one-piece integral casting including an intermediate or cylindrical portion 21 including opposite head and crankcase ends 23 and 25, respectively, a head end portion 31 extending from the head end 23 of the intermediate or cylindrical portion 21, and a crankcase portion 33 which extends from the crankcase end 25 of the intermediate or cylindrical portion 21 and which partially defines a crankcase 35. The cylindrical portion 21 also includes a cylindrical bore 37 which has an axis 39 and which receives the liner 15.

Figure 2:
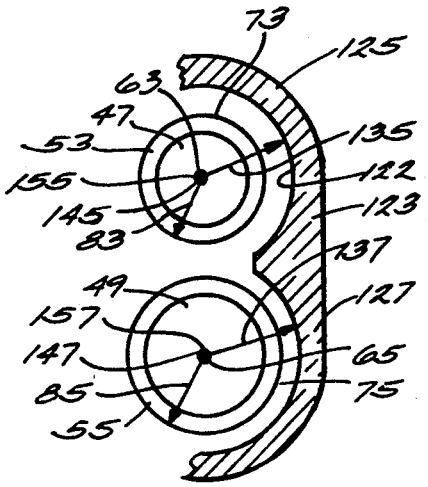
FIG. 2 is a fragmentary view taken along line 2—2 of FIG. 1.

The head end portion 31 of the engine block 13 includes a planar, centrally open, ring shaped, cylinder end surface 41 extending perpendicularly to the axis 39 of the cylindrical portion 21, and an inclined valve seat surface 43 which extends from a portion of the cylinder end surface 41 and which defines (see FIG. 2) inlet and exhaust openings or ports 47 and 49 and annular inlet and exhaust valve seats 53 and 55, respectively, located in the inclined surface 43 in surrounding relation to the inlet and exhaust ports 47 and 49. The inlet and exhaust ports 47 and 49 each respectively include centers 63 and 65 and the valve seats 53 and 55 include respective outer perimeters 73 and 75 located at respective radii 83 and 85 from the respective centers 63 and 65.

Extending from the inlet and exhaust ports 47 and 49 in the head end portion 31 are respective inlet and exhaust passages 93 (only one shown). Extending through the inlet and exhaust passages 93 for engagement with the inlet and exhaust valve seats 53 and 55 are respective inlet and exhaust valves 103 (only one shown).

The head end portion 31 also includes additional surface(s) 107 which extend between the inclined surface 43 and the annular cylinder end surface 41 to define a portion of a variable volume combustion chamber 109 also defined by the cylindrical portion 21 of the engine block 13 and by a piston (not shown). The surface(s) 109 can be of any suitable shape and can be apertured and threaded as shown at 111 to accommodate a spark plug (not shown).

The head end portion 31 and the cylindrical or intermediate portion 21 also include suitable water jacket cavities 115 to afford cooling of the engine block 13.

The crankcase portion 33 includes a partially cylindrical portion 121 which constitutes a continuation of the cylindrical bore 37. In addition, and in order to permit access for economical machining of the valve seat surface 43, the crankcase portion 33 also includes a relatively outwardly extending recessed portion 123 which includes a peripheral wall 122 including a pair of adjacent lobes 125 and 127 which facilitate machining of the inlet and outlet valve seats 53 and 55 and which are respectively generated by respective radii 135 and 137 extending perpendicularly to respective lines or axes 145 and 147 extending perpendicularly from the inclined valve seat surface 43 and from the center points 155 and 157 of the respective inlet and exhaust ports 47 and 49, which radii 135 and 137 are greater than the radius or distance from the centers points 155 and 157 of the inlet and exhaust ports 47 and 49 to the outer perimeter 73 and 75 of the valve seats 53 and 55. Accordingly, the inlet and exhaust valve seat machining lobes 125 and 127 in the crankcase portion 33 of the engine block 13 afford introduction along the axis 145 and 147 extending from the center points 155 and 157 of the valve seats 53 and 55 so as to afford machining of the valve seats 53 and 55 by simple rotary motion of the tools employed.

Various of the features of the invention are set forth in the following claims.

I claim:

1. A four-stroke engine comprising a block having an intermediate portion defining a cylindrical bore having an axis, a head end, and a crankcase end, a head end portion extending from said head end of said intermediate portion in integral one-piece relation thereto and including a planar valve seat surface extending at an acute angle to said axis of said cylindrical bore and having a valve seat inlet, a valve seat center and a perimeter defined by a radius extending from said valve seat center, and a crankcase end portion extending from said crankcase end of said intermediate portion in integral one-piece relation thereto and including a partially cylindrical portion coaxially aligned with said cylindrical bore, and a recessed portion extending from said partially cylindrical portion and having a peripheral wall spaced at a distance greater than said radius from a line extending perpendicularly to said valve seat surface and from said valve seat center.

2. A four-stroke engine comprising a one-piece block having an intermediate portion defining a cylindrical bore having an axis, a head end, and a crankcase end, a head end portion integrally extending from said head end of said intermediate portion and including an inclined surface extending at an acute angle to said axis of said cylindrical bore and having an exhaust port valve seat and inlet port valve seat having respective centers and perimeters defined by radii extending from said centers, and a crankcase end portion integrally extending from said crankcase end of said intermediate portion and including a partially cylindrical portion coaxially aligned with said cylindrical bore, and a recessed portion extending from said partially cylindrical portion and having a peripheral wall including first and second lobes respectively defined by wall surfaces, each to be spaced at a distance greater than each said respective radius from respective lines extending perpendicularly from said inclined surface and from each said respective valve seat center.

* * * * *